US005886631A

United States Patent [19]

Ralph

[11] Patent Number: 5,886,631

[45] Date of Patent: Mar. 23, 1999

[54] BARKING DOG SOUND ALARM SYSTEM

[76] Inventor: Leo N Ralph, Box 314, Belle Ewart, Ontario, Canada, L0L 1C0

[21] Appl. No.: 794,918

[22] Filed: Feb. 4, 1997

Related U.S. Application Data

[60] Provisional application No. 60/011,231, Feb. 6, 1996.

[51] Int. Cl. [6] ..... G08B 13/00

[52] U.S. Cl. ..... 340/541; 340/692; 340/573; 340/565; 340/566; 340/693

[58] Field of Search ..... 340/541, 692, 340/573, 565, 566, 693; 369/19

[56] References Cited

U.S. PATENT DOCUMENTS 4,544,920 10/1985 Hamlin ..... 340/565

5,014,039 5/1991 Zelenka ..... 340/565

5,452,274 9/1995 Thompson ..... 369/19

*Primary Examiner*—Jeffery A. Hofsass

*Assistant Examiner*—Sihong Huang

[57] ABSTRACT

A new barking dog sound alarm system for scaring away intruders using the menacing sounds of a dog. The inventive device includes a microphone for detecting noise, a device to compare the detected noise level to a reference level so as to determine whether the detected noise is a potential intruder, a plurality of sound recordings of different excited dogs, a speaker for broadcasting one of the recordings, and a controller for activating one of the sound recordings when the detected noise is determined to be a potential intruder.

9 Claims, 3 Drawing Sheets

BARKING DOG SOUND ALARM SYSTEM

BACKGROUND OF THE INVENTION

Cross Reference to Related Application

This application claims the benefit of U.S. Provisional Application No. 60/011,231, filed Feb. 06, 1996.

1. Field of the Invention

The present invention relates to alarm systems and more particularly pertains to a new barking dog sound alarm system for scaring away intruders using the menacing sounds of a dog.

2. Description of the Prior Art

The use of alarm systems is known in the prior art. More specifically, alarm systems heretofore devised and utilized are known to consist basically of familiar, expected and obvious structural configurations, notwithstanding the myriad of designs encompassed by the crowded prior art which have been developed for the fulfillment of countless objectives and requirements.

Known prior art alarm systems include U.S. Pat. No. 4,571,583; U.S. Pat. No. 4,544,920; U.S. Pat. No. 4,074,247; U.S. Pat. No. 4,131,887; U.S. Pat. No. 4,212,007; U.S. Pat. No. 3,740,737; U.S. Pat. No. 5,450,063; U.S. Pat. No. 4,646,343; U.S. Pat. No. 4,835,520; U.S. Pat. No. 3,938,120; and U.S. Pat. No. Des. 334,930.

Of the above mentioned patents, only patents U.S. Pat. No. 4,571,583 and U.S. Pat. No. 4,544,920 utilize detected noise to activate prerecorded sounds of a menacing dog to scare away intruders. However, these devices do not contain a way to determine whether the detected noise is a potential intruder or innocent ambient noise, thus the alarms in these devices will be needlessly sounded in many instances. In addition, these devices utilize only a single recorded dog sound, so these alarms cannot be tailored to the individual user's preference and the users personal situation.

While these devices fulfill their respective, particular objectives and requirements, the aforementioned patents do not disclose a new barking dog sound alarm system. The inventive device includes a microphone for detecting noise, a device to compare the detected noise level to a reference level so as to determine whether the detected noise is a potential intruder, a plurality of sound recordings of different excited dogs, a speaker for broadcasting one of the recordings, and a controller for activating one of the sound recordings when the detected noise is determined to be a potential intruder.

In these respects, the barking dog sound alarm system according to the present invention substantially departs from the conventional concepts and designs of the prior art, and in so doing provides an apparatus primarily developed for the purpose of scaring away intruders using the menacing sounds of a dog.

SUMMARY OF THE INVENTION

In view of the foregoing disadvantages inherent in the known types of alarm systems now present in the prior art, the present invention provides a new barking dog sound alarm system construction wherein the same can be utilized for scaring away intruders using the menacing sounds of a dog.

The general purpose of the present invention, which will be described subsequently in greater detail, is to provide a new barking dog sound alarm system apparatus and method which has many of the advantages of the alarm systems mentioned heretofore and many novel features that result in a new barking dog sound alarm system which is not anticipated, rendered obvious, suggested, or even implied by any of the prior art alarm systems, either alone or in any combination thereof.

To attain this, the present invention generally comprises a microphone for detecting noise, a device to compare the detected noise level to a reference level so as to determine whether the detected noise is a potential intruder, a plurality of sound recordings of different excited dogs, a speaker for broadcasting one of the recordings, and a controller for activating one of the sound recordings when the detected noise is determined to be a potential intruder.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new barking dog sound alarm system apparatus and method which has many of the advantages of the alarm systems mentioned heretofore and many novel features that result in a new barking dog sound alarm system which is not anticipated, rendered obvious, suggested, or even implied by any of the prior art alarm systems, either alone or in any combination thereof.

It is another object of the present invention to provide a new barking dog sound alarm system which may be easily and efficiently manufactured and marketed.

It is a further object of the present invention to provide a new barking dog sound alarm system which is of a durable and reliable construction.

An even further object of the present invention is to provide a new barking dog sound alarm system which is susceptible of a low cost of manufacture with regard to both materials and labor, and which accordingly is then susceptible of low prices of sale to the consuming public, thereby making such barking dog sound alarm system economically available to the buying public.

Still yet another object of the present invention is to provide a new barking dog sound alarm system which provides in the apparatuses and methods of the prior art some of the advantages thereof, while simultaneously overcoming some of the disadvantages normally associated therewith.

Still another object of the present invention is to provide a new barking dog sound alarm system for scaring away intruders using the menacing sounds of a dog.

Yet another object of the present invention is to provide a new barking dog sound alarm system which includes a microphone for detecting noise, a device to compare the detected noise level to a reference level so as to determine whether the detected noise is a potential intruder, a plurality of sound recordings of different excited dogs, a speaker for broadcasting one of the recordings, and a controller for activating one of the sound recordings when the detected noise is determined to be a potential intruder.

Still yet another object of the present invention is to provide a new barking dog sound alarm system that utilizes sounds from a plurality of different dogs, allowing the user to select the sound which is most appropriate to their needs and circumstances.

Even still another object of the present invention is to provide a new barking dog sound alarm system that is easy to install, requires no household wiring, and is small and discrete.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
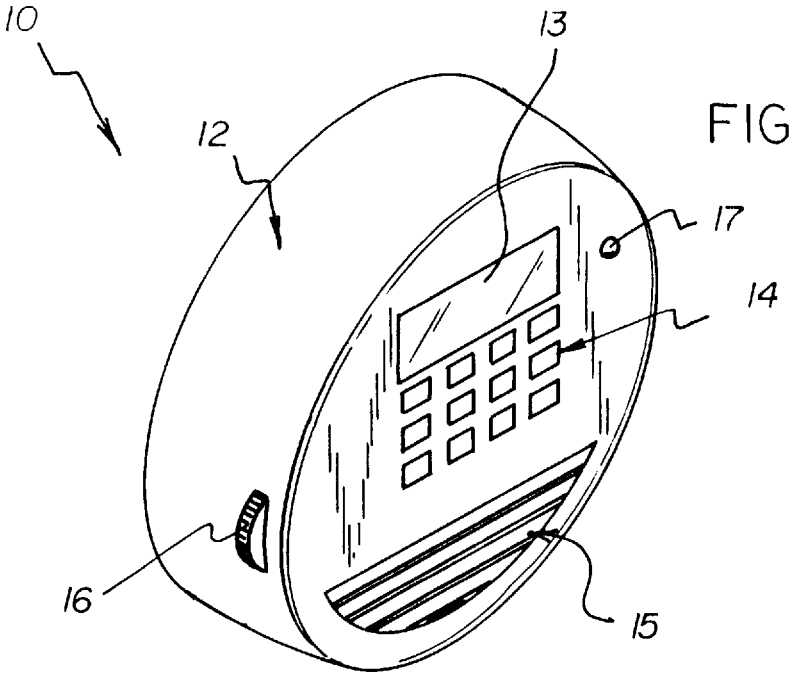
FIG. 1 is a perspective view of the alarm housing.
Figure 2:
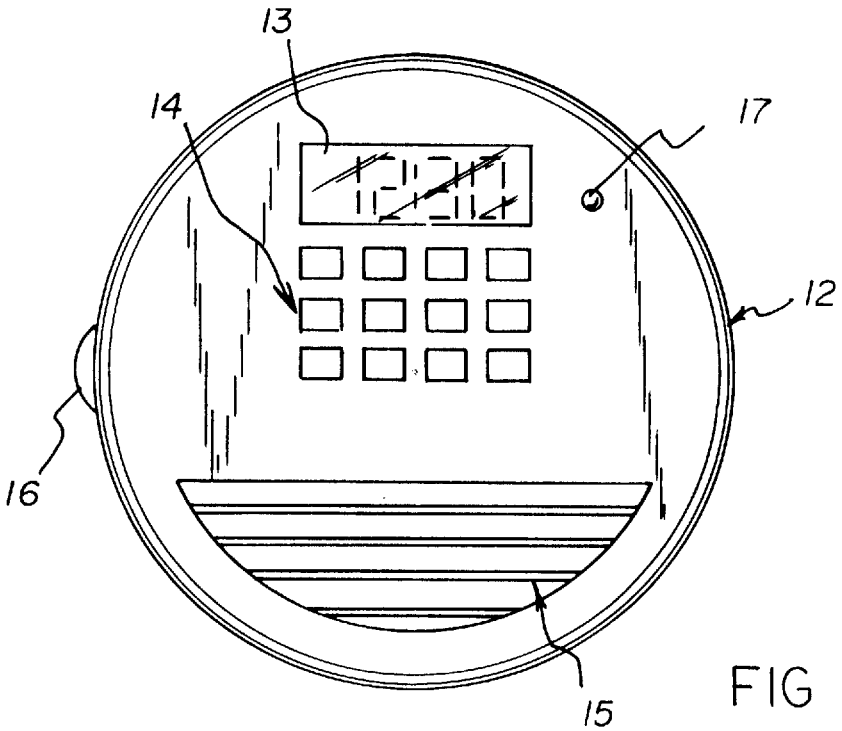
FIG. 2 is a front view of the alarm housing.
Figure 3:
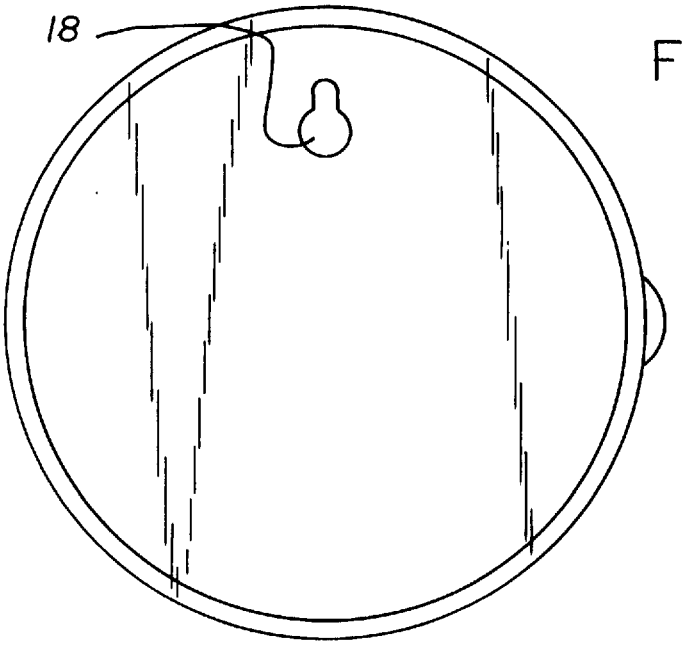
FIG. 3 is a rear view of the alarm housing.

With reference now to the drawings, and in particular to FIGS. 1 through 3 thereof, a new barking dog sound alarm system embodying the principles and concepts of the present invention and generally designated by the reference numeral 10 will be described.

As best illustrated in FIGS. 1 through 3, the barking dog sound alarm system 10 comprises a substantially circular alarm housing 12 made from plastic or other suitable material. The housing 12 includes on a front side thereof a display screen 13 for displaying various messages, a keypad 14 for controlling operation of the system 10 and for entering data, a speaker 15 for broadcasting the barking dog sounds, an on/off volume control 16 for turning the system 10 on and off and for manually adjusting the broadcast volume from the speaker 15, and a battery indicator light 17 for indicating a low battery condition. As illustrated in FIG. 3, the back side of the housing 12 includes a mounting groove 18 therein for mounting the housing to a wall or any convenient support structure. Although a single alarm unit 10 is shown and described, it should be apparent that a plurality of such devices could be mounted throughout a dwelling, in order to protect all areas of the dwelling.

Figure 4:
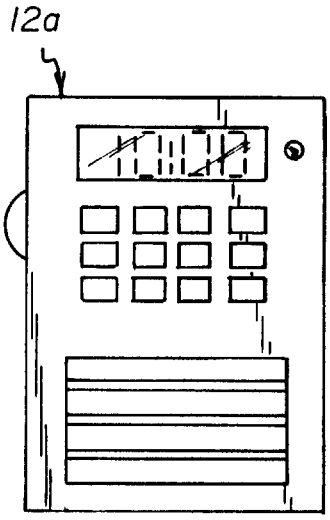
FIG. 4 is a front view of an alternate alarm housing.
Figure 5:
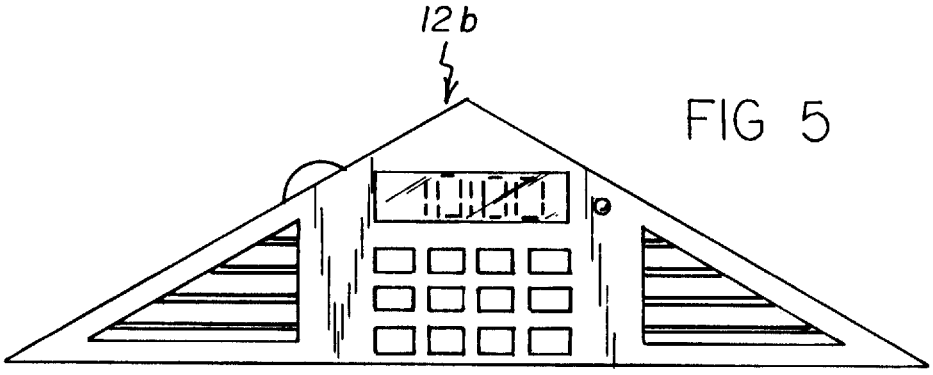
FIG. 5 is a front view of another alternate alarm housing.

FIGS. 4 and 5 illustrate alarm systems similar to the system of FIGS. 1–3, except in FIG. 4 the housing 12*a* is rectangular, and in FIG. 5, the housing 12*b* is generally triangular. Housing shapes other than those shown could be utilized as well without changing the scope of the invention.

Figure 6:
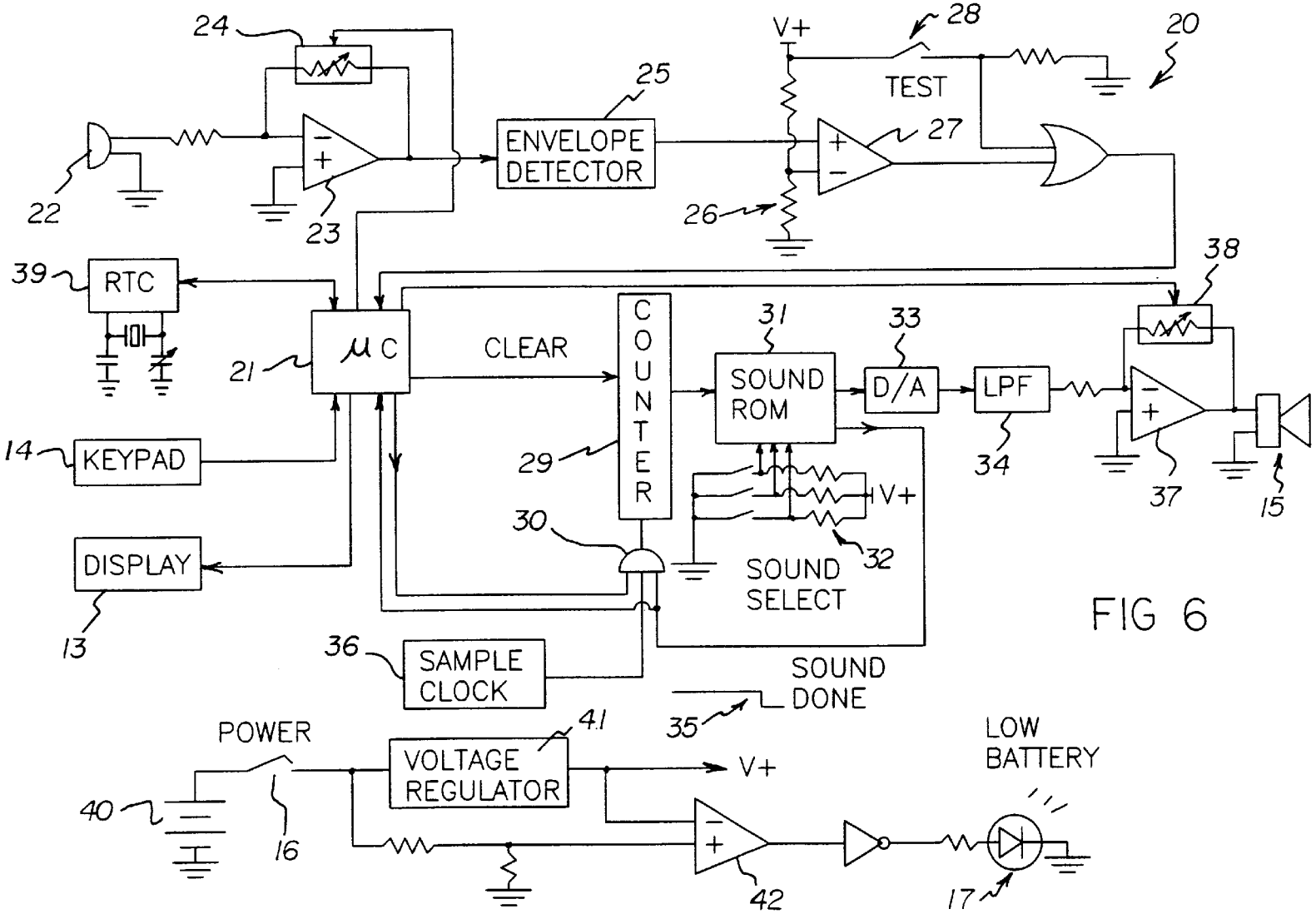
FIG. 6 is a view of an electric circuit useable with the invention.

Turning now to FIG. 6, illustrated therein is a circuit 20 for use with the present invention. A microcontroller 21 is provided to control the operation of the circuit 20. Sounds are detected by a conventional microphone 22 located in or on the housing 12. The microphone's amplifier 23 has a digital potentiometer 24 associated therewith which is controlled by the microcontroller 21, permitting control of the pick-up sensitivity of the microphone. The envelope detector 25, basically a rectifier and a low-pass filter, then determines the average sound level detected. The average sound level determined by the envelope detector 25 is then compared against a reference level determined by resistor voltage divider 26 within a comparator, such as op-amp 27. The reference level should be chosen so that normal ambient sounds, such as television noise and conversational noise, do not activate the alarm. Therefore, when the average sound level is greater than the reference level, this would indicate the potential presence of an intruder. When the detected average sound level exceeds the reference level, a signal is sent to the microcontroller 21. A test switch 28 is also provided within the circuit to test the operation thereof.

When the microcontroller 21 receives the signal, it clears the sound ROM address counter 29 and asserts a high on its input to the three-input AND gate 30. A plurality of sounds, such as barking and growling, from different excited dogs are prerecorded on the sound ROM 31. For instance, sounds from a German Sheppard, a Rottweiler, a Pit Bull, etc. could be used, with these sounds being appropriate for protecting commercial areas and large homes, which are likely places for such animals. For apartments or small homes, the sound ROM can include sounds of a Poodle or other small dog, such dogs being more appropriate for these types of dwellings. Therefore the user can select the dog sound most appropriate to their situation, to provide a more realistic effect.

A plurality of sound select switches 32, in the instant case three switches, control high address lines to select a particular sound block from the sound ROM 31, while the address counter controls lower address lines to output samples within the chosen block. Sound will play as the counter 29 increases, causing data from the sound ROM 31 to be converted to an analog signal through the D/A converter 33 and low-pass filter 34. The counter 29 continues to increment until a special "sound done" data output line 35 goes low, indicating that the end of the recorded sound has been reached. The counter 29 is automatically stopped at this point, since the "sound done" line 35 is gated with the counter's clock signal from a sample clock 36. The clock signal from the clock 36, which is the sample rate, should be somewhere between 8 kHz and 40 kHz.

The analog signal is then sent to the speaker amplifier 37, whose gain is set by digital potentiometer 38 controlled by the microcontroller 21. This permits the broadcast volume from the speaker 15 to be controlled by the microcontroller, which automatically adjusts the volume during broadcast to provide fading effects. Fading effects simulate the movement of a dog within the dwelling, such that when the volume decreases this simulates a dog moving away from the listener, and when the volume increases this simulates a dog moving toward a listener. Thus an intruder is not able to ascertain whether a real dog is present or not.

The circuit 20 also includes a real-time-clock (RTC) 39 in communication with the microcontroller for controlling the alarm system 10 based upon the day and the time of day. For instance, the alarm system could increase its sensitivity at night when the user is sleeping, or when the user is away from home. The keypad 14 and display 13 allow the user to set dates and times, program timer functions, set volumes, etc.

The alarm system 10 is powered by a battery or batteries 40. A voltage regulator 41 is provided to provide whatever voltage is required by the logic. Voltage comparator 42 monitors the voltage level in the battery 40 and lights the indicator light 17 when the voltage drops below a predetermined level, thus indicating that the battery needs changing.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A barking dog sound alarm system, comprising:

a noise detection means being for detecting noise;

a screening means being adapted for determining whether a detected noise indicates the potential presence of an intruder;

a prerecorded response having at least one recording of sounds of at least one agitated dog;

at least speaker for broadcasting said at least one recording;

a control means responsive to said screening means, said control means for activating said prerecorded response for broadcast by said at least one speaker; and volume adjustment means for adjusting a broadcast volume of the at least one speaker, said volume adjustment means being adapted for automatically adjusting the volume during broadcast of said at least one sound recording in order to simulate a dog moving about an interior of a dwelling.

2. The barking dog sound alarm system of claim 1, further including pick-up control means for controlling the pick-up sensitivity of said noise detection means.

3. The barking dog sound alarm system of claim 1, wherein said prerecorded response includes a plurality of sound recordings from a plurality of different types of dogs which are agitated.

4. The barking dog sound alarm system of claim 3, further including a selection means for selecting one of said plurality of sound recordings for broadcast from said at least one speaker.

5. The barking dog sound alarm system of claim 1, further including a timer means for controlling operation of the alarm system based upon the day and the time of day.

6. The barking dog sound alarm system of claim 1, wherein the noise detection means, the screening means, the prerecorded response, the at least one speaker, and the control means are all disposed within an alarm housing, said alarm housing further including a keypad, said keypad being for controlling the operation of the alarm system.

7. The barking dog sound alarm system of claim 6, further comprising a display screen for displaying operating conditions of the alarm system.

8. The barking dog sound alarm system of claim 6, further comprising a battery within the alarm housing for providing electrical power to the alarm system, a monitoring means for monitoring the voltage level of the battery, and a voltage indicating means for indicating when the voltage drops below a predetermined level.

9. A barking dog sound alarm system, comprising:

a noise detection means for detecting noise;

a screening means for determining whether a detected noise indicates the potential presence of an intruder;

a prerecorded response having at least one recording of sounds of at least one agitated dog;

at least one speaker for broadcasting said at least one recording;

a control means responsive to said screening means, said control means for activating said prerecorded response for broadcast by said at least one speaker;

a pick-up control means for controlling the pick-up sensitivity of said noise detection means;

said prerecorded response including a plurality of sound recordings from a plurality of different types of dogs which are agitated;

a selection means for selecting one of said plurality of sound recordings for broadcast from the at least one speaker;

a volume adjustment means for adjusting a broadcast volume of the at least one speaker;

said volume adjustment means being adapted for automatically adjusting the volume during broadcast of one of said plurality of sound recordings in order to simulate a dog moving about an interior of a dwelling;

a timer means for controlling operation of the alarm system based upon the day and the time of day;

wherein the noise detection means, the screening means, the prerecorded response, the at least one speaker, and the control means are all disposed within a housing, said housing further including a keypad for controlling the operation of the alarm system;

a display screen for displaying operating conditions of the alarm system;

a battery within the alarm housing for providing electrical power to the alarm system;

a monitoring means for monitoring the voltage level of the battery; and a voltage indicating means for indicating when the voltage drops below a predetermined level.

* * * * *